United States Patent [19]

Zenz

[11] 4,072,130

[45] Feb. 7, 1978

[54] APPARATUS AND METHOD FOR GENERATING STEAM

[75] Inventor: Frederick A. Zenz, Garrison, N.Y.

[73] Assignee: The Ducon Company, Inc., Mineola, N.Y.

[21] Appl. No.: 746,364

[22] Filed: Dec. 1, 1976

[51] Int. Cl.[2] ..... F22B 1/02

[52] U.S. Cl. ..... 122/4 D; 110/28 J

[58] Field of Search ..... 122/4 D; 110/28 J; 34/57 A; 23/288 S

[56] References Cited

U.S. PATENT DOCUMENTS

| | | | |
|---|---|---|---|
| 3,687,115 | 8/1972 | Bell | 122/4 |
| 3,696,793 | 10/1972 | Bell | 110/28 |
| 3,904,548 | 9/1975 | Fagen et al. | 23/288 |
| 3,924,402 | 12/1975 | Harboe | 122/4 |

*Primary Examiner*—Kenneth W. Sprague

*Attorney, Agent, or Firm*—Seidel, Gonda & Goldhammer

[57] ABSTRACT

Steam is generated in a controlled manner as a function of the steam demand by way of a combustor adapted to burn a fuel such as high sulfur coal in a fluidized bed. The steam demand and the steam available to supply the demand are modulated to change the rate of production of steam as a function of controlling the fluidization of fuel beds and/or the height of fuel in the beds. Any fuel beds which are slumped are maintained at a temperature slightly above the flash point temperature of the fuel.

11 Claims, 6 Drawing Figures

FIG. 2
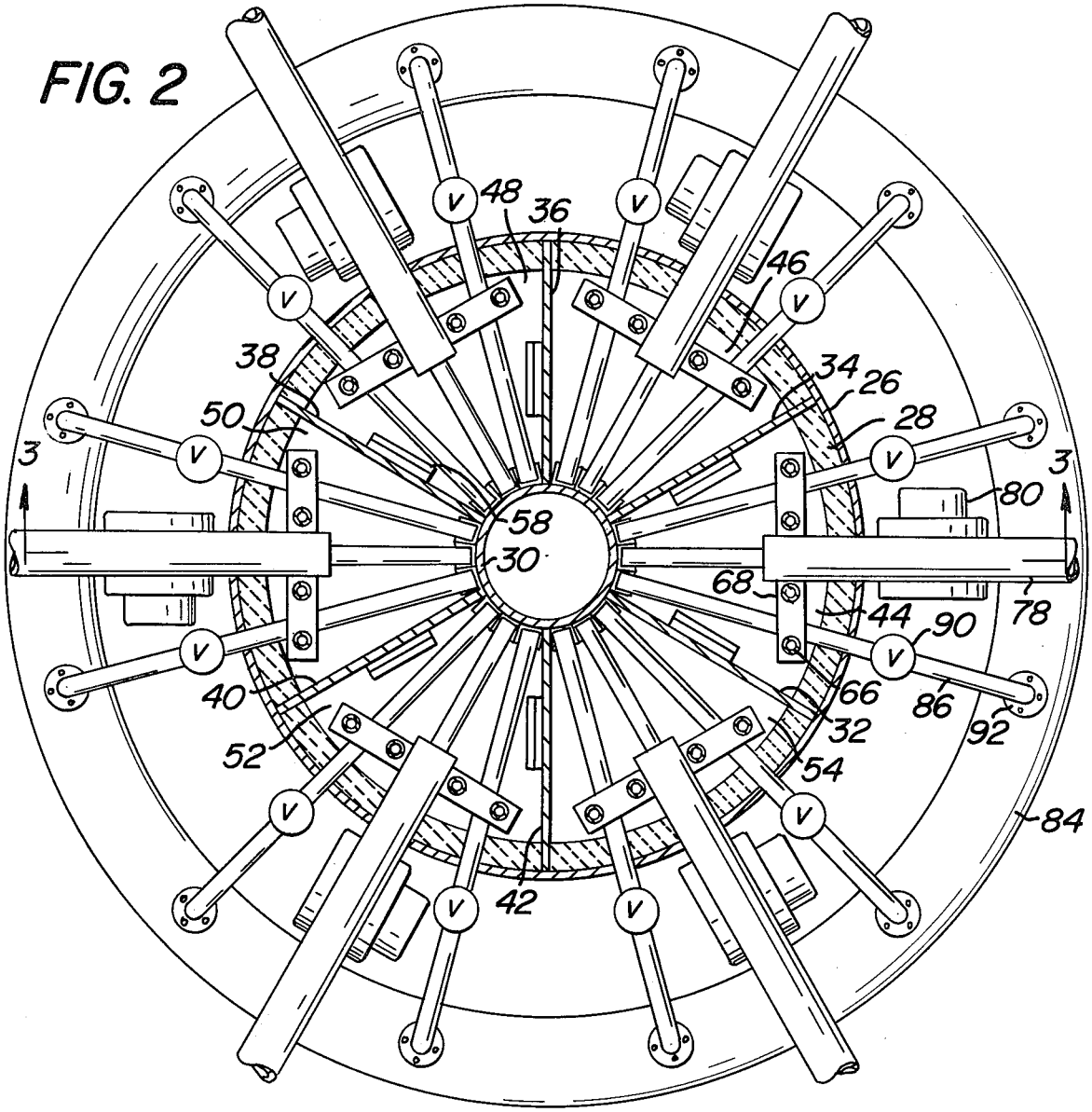
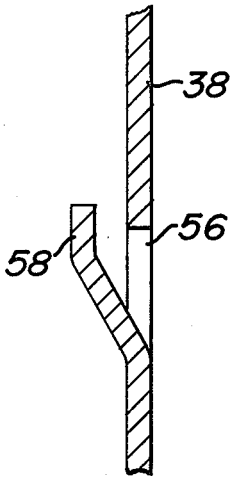
FIG. 4

APPARATUS AND METHOD FOR GENERATING STEAM

BACKGROUND

There is a need for equipment for generating steam by use of fuel such as a high sulfur coal. Systems adapted to burn high sulfur coal by way of fluidized beds have been proposed heretofore. For example, see U.S. Pat. Nos. 3,387,490 and 3,763,830. The systems disclosed by said patents have not been widely adopted since they lack a number of control features and have several disadvantages.

In connection with a fluidized bed, said prior art systems use an upshot grid for discharging the fluidizing gas upwardly toward the bed. A downshot grid discharges the fluidizing gas downwardly in a direction away from the bed. Per se, a downshot grid is known. For example, see the downshot grid in U.S. Pat. No. 3,904,548. Downshot grids such as that disclosed in the last-mentioned patent are not practical for use in the individual combustion chambers of a combustor, do not facilitate removal of the grid in any one chamber for purposes of repair, and otherwise lack features of the present invention.

SUMMARY OF THE INVENTION

In accordance with the present invention, steam is generated within a combustor housing having a plurality of discrete chambers side by side and separated by upright walls. Water flows upwardly through at least one vertically disposed tube bundle in each chamber. The steam output of the tube bundles is combined for distribution. A fuel bed in each chamber is adapted to be fluidized to a height so that at least the lower end of the tube bundle in each chamber is disposed within the fluidized bed.

Fluidizing air is introduced to each chamber through a discrete independently operable downshot grid. The number of downshot grids corresponds to the number of chambers. Each such grid is disposed adjacent the lower end of its respective chamber.

The vertically disposed walls which separate adjacent chambers are made of a good heat conductive material to assist in maintaining the temperature of any slumped bed in excess of the flashpoint of the fuel. Steam and/or water may be routed through the tube bundle of any slump bed to assist in maintaining the temperature of the slumped fuel bed slightly above the flashpoint of the fuel.

The steam demand and the steam rate of production are modulated by controlling fluidization of the beds wherein one or more non-adjacent beds are slumped and/or changing the height of fuel in one or more of the fluidized beds. Ash is removed by way of a draw-off hopper below the elevation of the grids. The draw-off hopper is tapered to the angle of friction of the ash solids so that they descend as a mass.

It is an object of the present invention to provide novel apparatus and method for generating steam in a controlled manner whereby generation of steam is modulated with the steam demand and steam is produced in a manner whereby a response to a change in steam demand is complied with within a short period of time.

It is another object of the present invention to provide novel apparatus and method for generating steam by way of discrete fluidized beds which have cross flow between adjacent beds only so long as the adjacent beds are fluidized.

It is another object of the present invention to provide novel apparatus and method for generating steam which involves fluidizing beds by a downshot grid which are capable of being controlled independently and are removable for repair purposes.

It is another object of the present invention to provide apparatus and method for generating steam which provides for a vernier-like control for maintaining a desired temperature for slumped bed.

Other objects will appear hereinafter.

For the purpose of illustrating the invention, there is shown in the drawings a form which is presently preferred; it being understood, however, that this invention is not limited to the precise arrangements and instrumentalities shown.

FIG. 2 is a sectional view taken along the line 2—2 in FIG. 1.

FIG. 4 is a sectional view taken along the line 4—4 in FIG. 3.

Figures 1, 6:
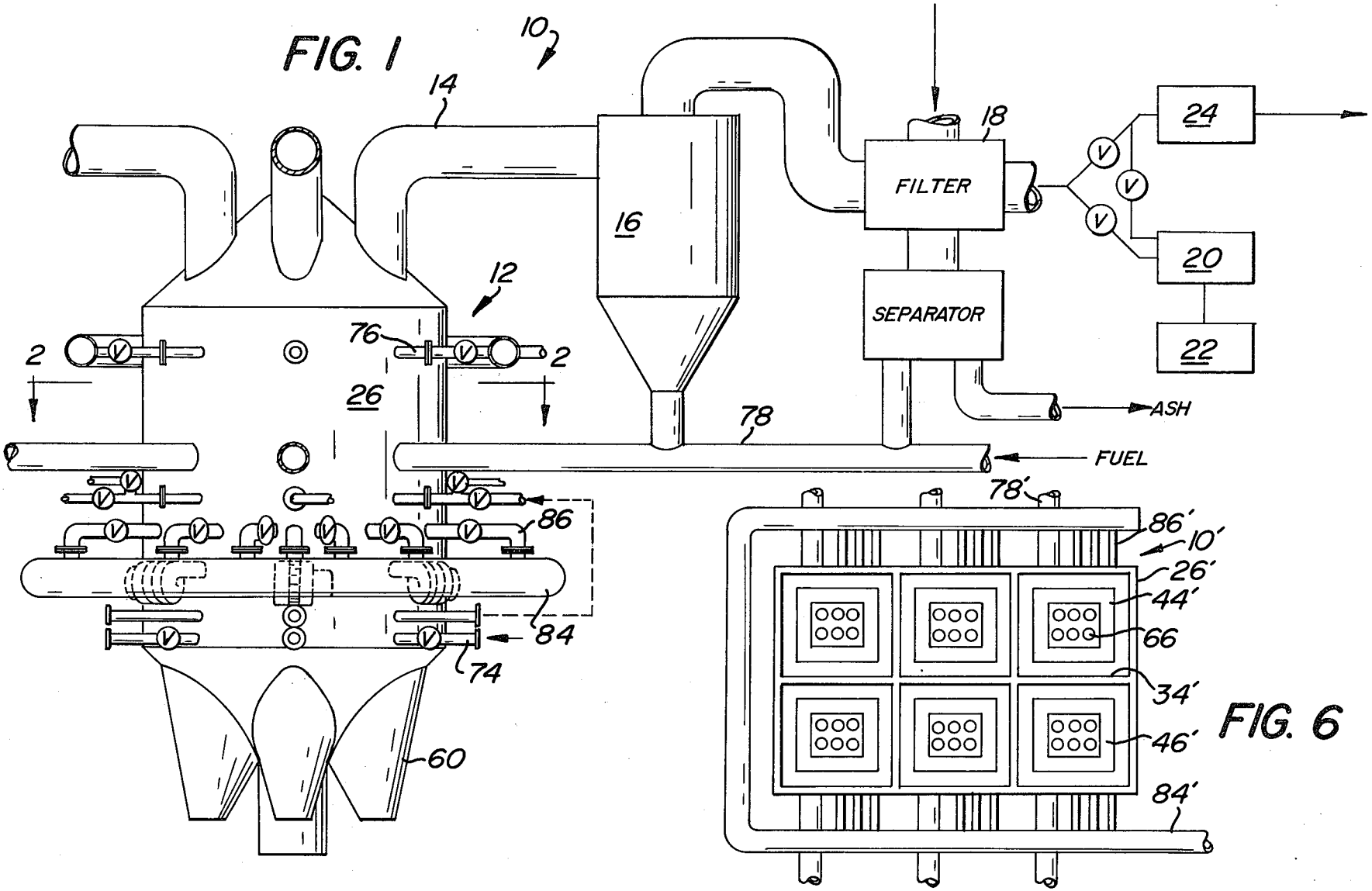
FIG. 1 is an elevation view of apparatus in accordance with the present invention.
FIG. 6 is a diagrammatic plan view of an alternative embodiment for the combustor.

Referring to the drawing in detail, wherein like numerals indicate like elements, there is shown in FIG. 1 apparatus in accordance with the present invention designated generally as 10. The apparatus 10 includes a combustor 12 having a plurality of exhaust conduits 14. Each exhaust conduit 14 is connected to a cyclone separator 16. The effluent from the cyclone separator 16 is directed to a granular bed filter 18.

The effluent from the granular bed filter 18 is selectively directed to either turbine 20 or cooler 24 from which the fluent is directed to a stack for discharge to the surrounding atmosphere. Valved conduits extend between filter 18, turbine 20 and cooler 24. Turbine 20 is connected to a generator 22. Thus, turbine 20 and generator 22 are utilized to recover power in a manner per se known to those skilled in the art.

The combustor 12 includes a housing 26 which is circular as shown in FIG. 2 and is compatible with pressurized as well as near atmospheric operation. Housing 26 may have other configurations as will be made clear hereinafter. A fire brick lining 28 is provided on the interior of the housing 26. Housing 26 is provided with a hollow core 30. A plurality of partitions 32–42 extend from the core 30 to the fire brick lining 28 thereby dividing the interior of the housing 26 into a plurality of combustion chambers 44–54 of uniform size.

The partitions 32–42 are made from a good heat conducting material which preferably also acts as a heat sink. Suitable materials for the partitions include copper, iron, etc. Each partition is provided with an opening 56 providing communication between adjacent chambers. Each opening 56 is provided with a guard member 58 extending to an elevation above the opening whereby a seal will be provided between adjacent chambers if one of the chambers is slumped without effecting the ability of cross flow between adjacent chambers that are fluidized. As shown in FIG. 4, there are no adjustable parts.

Figure 3:
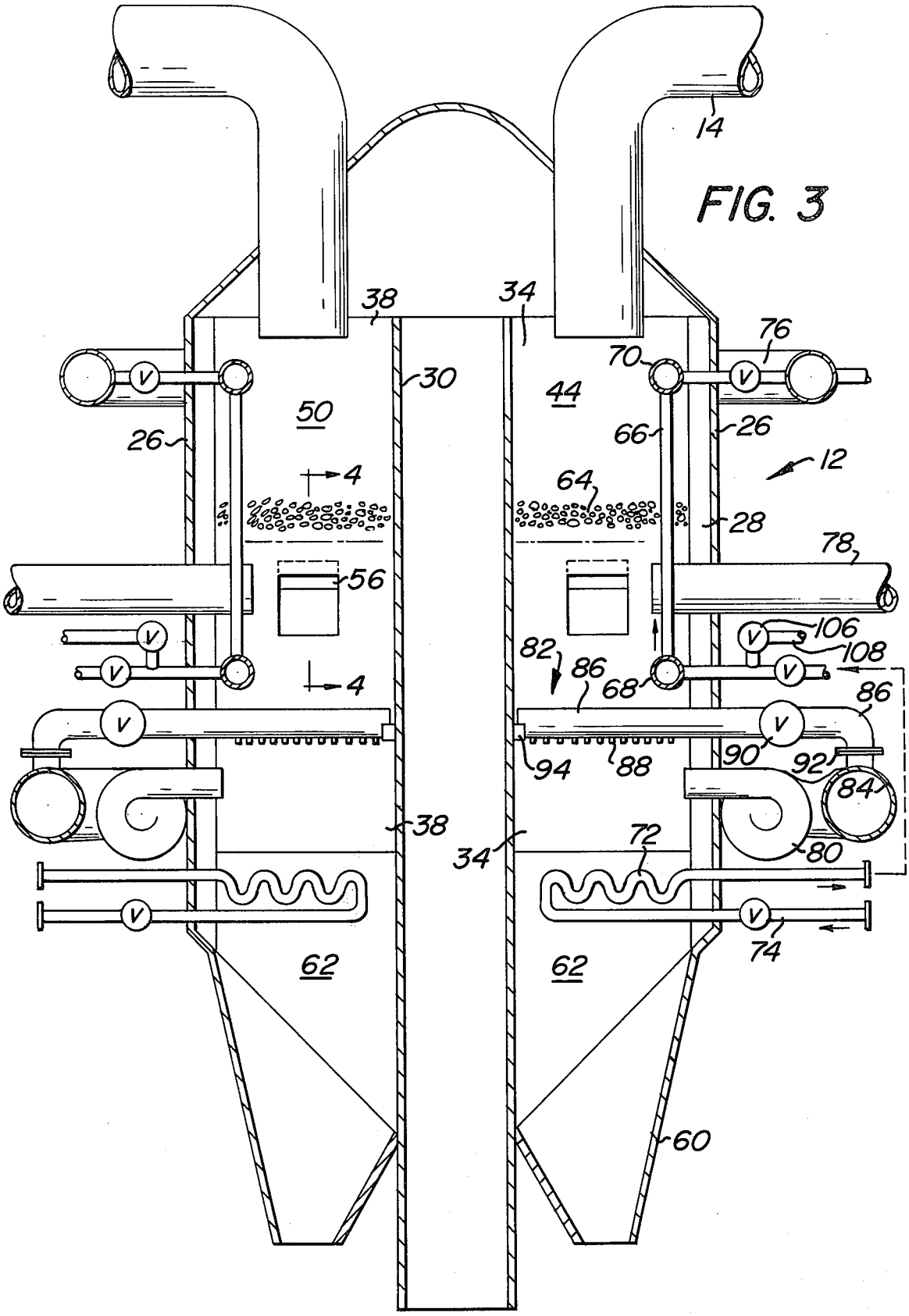
FIG. 3 is a sectional view taken along the line 3—3 in FIG. 2.

A collection chamber 62, in direct communication with each of the chambers 44–54, is provided with the housing 26 below the elevation of said combustion chambers. See FIG. 3. A plurality of draw-off hoppers 60 are provided. Each hopper 60 communicates at its upper end directly with the collection chamber 62. The walls of each hopper 60 are tapered to the angle of friction of the ash solids so that the solids descend as a mass.

A fuel bed 64 is provided within each of the combustion chambers 44–54. A variety of different fuels may be utilized for the bed 64. A preferred fuel is high sulfur coal mixed with limestone, dolomite, etc. The apparatus of the present invention facilitates removal of impurities from the effluent which otherwise would prohibit the use of high sulfur coal from an ecological viewpoint.

At least one tube bundle 66 is provided within each combustion chamber with the lower end of the tube bundles being embedded within their respective fuel beds 64. Since each of the combustion chambers is identical, only the features of chamber 44 will be described in detail. The tube bundle 66 includes vertically disposed conduits extending between an inlet manifold 68 and an output manifold 70. While only four vertically disposed conduits of tube bundle 66 are illustrated, a greater number of such conduits are contemplated.

Water from a valved supply conduit 74 passes through a preheat coil 72 disposed within the collection chamber 62 and then is directed to the inlet manifold 68 at the lower end of the tube bundle 66. Water is passed upwardly through the tube bundle 66 and converted into steam for discharge through valved conduit 76 to a manifold which leads to a steam drum which supplies the demand steam.

A fuel supply conduit 78 communicates with each combustion chamber adjacent the lower end thereof. The lower end of cyclone separator 16 communicates with the conduit 78 so that any collected solids, including limestone, may be returned to the combustor 12. Also, limestone may be separated from ash at the separator portion of the granular bed filter 18 so that such limestone may be mixed with the fuel in conduit 78 and pneumatically conveyed to the combustion chamber. To facilitate independent ignition of the fuel in each of the fuel combustion chambers 44–54, a discrete igniter 80 of conventional construction is provided for each combustion chamber.

Each combustion chamber 44–54 is provided with a discrete selectively and independently operable downshot grid 82 which is non-sifting whereby bed inventory is not lost when a bed is slumped. Each grid 82 is connected at its inlet end to a gas supply manifold 84 which surrounds the housing 26. Each downshot grid 82 includes a plurality of radially disposed conduits 86 having discharge ports 88 for directing fluidizing air downwardly. Air discharged downwardly immediately flows upwardly to fluidize the bed thereabove. Each conduit 86 is provided with a flow control valve 90 and is connected to the manifold 84 by way of a readily separable joint 92 to facilitate removal of any one of the conduits 86. Conduits 86 are supported at their outer end by housing 26 and at their inner end by discrete support brackets 94. None of the conduits 86 are physically connected to their support brackets 94 thereby minimizing thermal expansion problems. Each bracket 94 is supported by the core 30.

Figure 5:
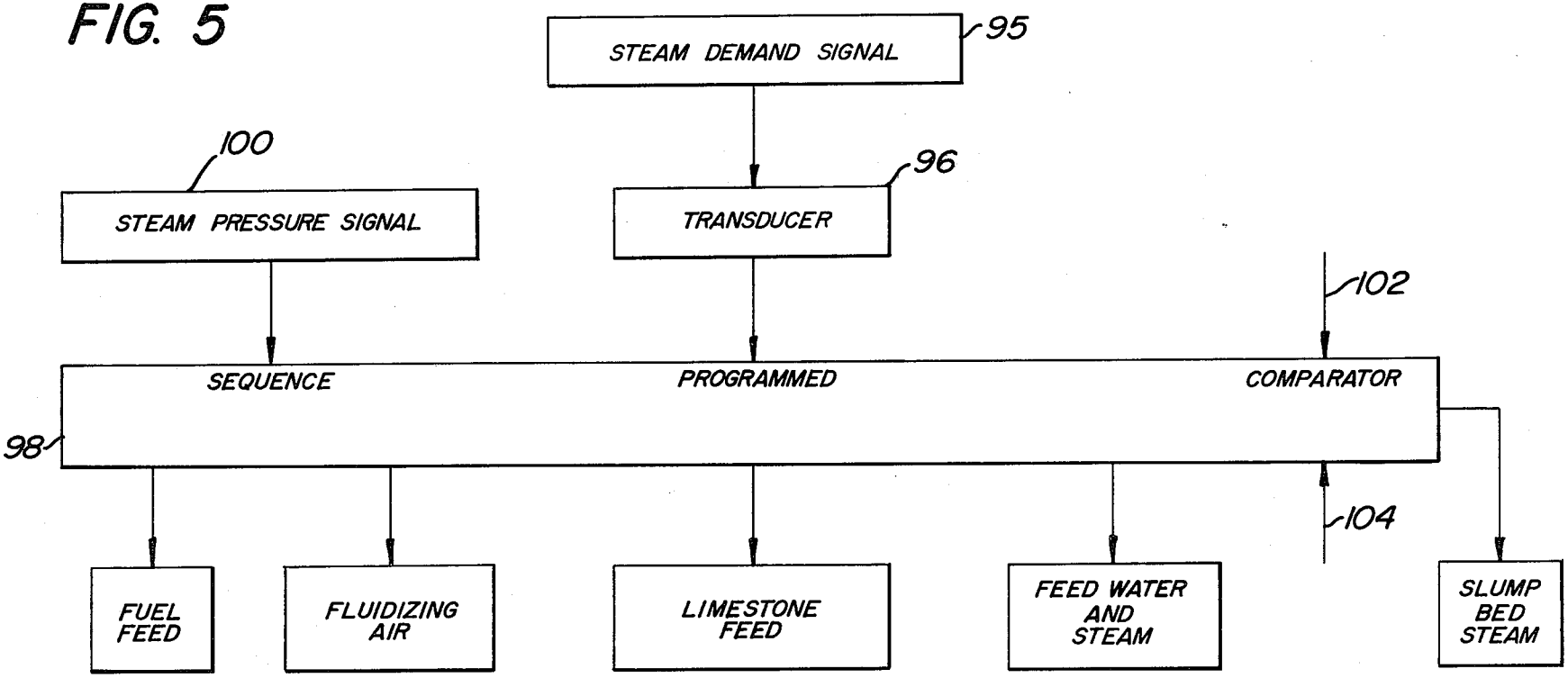
FIG. 5 is a block diagram showing a portion of the controls.

Referring to FIG. 5, the demand for steam is detected and a steam demand signal 95 is generated. Signal 95 is coupled through a transducer 96 to a sequence programmed comparator 98. The pressure of the steam available in the steam drum is detected and a signal 100 representing steam pressure is coupled to the comparator 98. The comparator 98 also receives a signal 102 from each of the fluidized beds indicating the height of each bed. Also, comparator 98 receives a signal 104 from each bed indicative of the temperature of each bed.

The comparator 98, in response to the said signals received by it, controls a number of variables and components of the apparatus 10. Thus, comparator 98 directs signals for controlling the fuel feed to each of the combustion chambers 44–54 whereby the supply of fuel to each chamber is independently controlled. Comparator 98 also controls valves for supplying fluidizing air to each conduit 86 of the downshot grids 82 to control the fluidization of the fuel bed 64 in each of the combustion chambers 44–54.

The comparator 98 controls the rate of feed of limestone to be added to the fuel. Comparator 98 controls the boiler feed water supply for the tube bundles in each of the combustion chambers 44–54 as well as the control valve between the steam drum and each of the steam bundles. The comparator 98 also is utilized to control the flow of steam through slumped beds whereby the steam from the steam drum may be routed through conduit 108 having valve 106 therein to the lower manifold 68 of steam bundle 66. Thus, this affords a vernier-type control to the extent of permitting steam produced in other chambers where fluidized combustion is occurring to be routed through the tube bundle immersed in a slumped bed for maintaining the temperature of the slumped bed at the desired level above the flashpoint temperature.

In FIG. 6, there is diagrammatically illustrated a plan view of an alternative embodiment of the present invention wherein the elements corresponding to those described above are indicated with corresponding primed numerals. In FIG. 6, the apparatus is rectangular in cross section instead of being circular in cross section. Except for the difference in shape, the respective embodiments are constructed in the same manner and operate to attain the same results as described above.

It will be appreciated by those skilled in the art that a number of conventional elements are not illustrated or described such as solenoids for valves, thermostats, insulation, meters and gauges, etc.

In view of the above description and the state of the art, those skilled in the art will not need a detailed explanation of operation. So long as two adjacent bed 64 are fluidized, the fuel may flow from one chamber to another for purposes of equalization by way of openings 56. However, if one bed is slumped, there will be no cross flow through opening 56 due to the guard member 58. As steam demand decreases, one or more non-adjacent beds 64 are slumped by shutting off fuel feed and fluidizing air to the respective downshot grid 82. A small bleed of fluidizing air may be fed to a slumped bed.

The temperature of any slumped bed is maintained slightly above the flashpoint temperature by the good heat conductive partition walls between adjacent chambers, bleeding of fluidizing air to the bed and/or the flowing of steam through the associated tube bundle partially immersed in the slumped bed. This assures that a slumped bed can be brought onstream within a matter of minutes if the steam demand signal 95 should rapidly increase.

The apparatus 10 provides the facility to change the height of the fuel bed 64 by increasing or decreasing the amount of fluidizing air and fuel to provide a control of the rate at which steam is generated in each combustion chamber. This facilitates changing the rate of production of steam to compensate for minor changes in the steam demand signal 95.

Because the grids 82 are downshot grids, slumped beds do not plug up the holes of discharge ports 88 on the conduits 86. The use of downshot grids also provides the advantage of having a low pressure drop. A suitable pressure drop for the grids is 0.2 to 0.4 psi. The construction of the grids as illustrated facilitates rapid removal of any grid conduit 86 for purposes of repair or replacement without effecting the fluidized beds in adjacent combustion chambers. When a grid conduit 86 is removed by disassembling joint 92, the joint 92 is immediately sealed to prevent loss of air pressure from the manifold 84. A low pressure drop minimizes the compressor power required to introduce combustion air. Each downshot grid prevents loss of inventory from the fuel bed 64 even though a bed is slumped.

Each of the tube bundles 66 utilizes vertically disposed tubes in a manner whereby the full height of the bed 64 may be in surface contact with the tubes of the tube bundle. Where the tubes of the tube bundle are horizontally disposed, erratic results are attained or control is difficult since the tubes are at different temperatures depending upon their elevation. Because of the nature of the draw-off hoppers 60, the ash and reacted limestone descends uniformly as a mass.

Notwithstanding the fact that the apparatus 10 may burn high sulfur coal, undesirable pollutants are removed by the scrubbing system which includes the cyclone separator 16, granular bed filter 18, and cooler 24 whereby sulfur dioxide is not discharged to the flue stack and a dry beneficial product in the form of $CaSO_4$ resulting from the reaction between sulfur dioxide and limestone at operating temperatures approximating 1500° to 1800° F.

The preheat coil 72 facilitates preheating the water to be converted to steam at the steam bundles and at the same time has a cooling effect on the ash particles within chamber 62. The fluidizing air is at a relatively cold temperature and due to the fact that it is directed downwardly from the ports 88, this also has a cooling effect on the particles within chamber 62. The cooperative effect of the downshot grids with the preheat coil 72 facilitates reduction of the temperature of the downflowing mass of ash plus reacted limestone to a temperature which is below that at which agglomeration of $CaSO_3$ and $CaSO_4$ might otherwise occur.

The present invention may be embodied in other specific forms without departing from the spirit or essential attributes attributes thereof and, accordingly, reference should be made to the appended claims, rather than to the foregoing specification as indicating the scope of the invention.

I claim:

1. A method of generating steam comprising:

a. providing a combustor housing with a plurality of discrete chambers side by side and separated by upright walls, b. flowing water upwardly through a separate vertically disposed tube bundle in each chamber, collecting the steam output from the upper end portion of said tube bundles for distribution, c. fluidizing a fuel bed in each of said chambers to a height so that at least the lower end of the tube bundle in each chamber is disposed in its respective bed, d. introducing fluidizing air to the bed of each chamber through a discrete independently operable downshot grid, the number of grids corresponding to the number of chambers and with each grid being adjacent the lower end of its respective chamber, e. using a good heat conductive material for said walls, maintaining the temperature of any slumped bed in excess of the flashpoint of the fuel, f. using at least one draw-off hopper below the elevation of the grids with the hopper being tapered to the angle of friction of the ash solids so that ash solids therein descend as a mass, g. igniting the fluidized beds, h. modulating at least one of the following as the amount of said collected steam and/or the demand for steam changes to thereby change the rate of production of steam in said tube bundles:

i. controlling fluidization of said beds whereby one or more non-adjacent beds are slumped, ii. changing the height of fuel in one or more of said fluidized beds.

2. A method in accordance with claim 1 including routing steam through the tube bundle of a slumped bed to assist in maintaining the temperature of the slumped bed in excess of the flashpoint of the fuel.

3. A method in accordance with claim 1 wherein said step of introducing fluidized air is accomplished with a pressure drop in the range of 0.2 to 0.4 psi.

4. A method in accordance with claim 1 wherein said modulating step includes comparing a steam demand signal with a steam pressure signal, a signal indicative of the temperature of each bed, and a signal indicative of the height of each bed.

5. A method in accordance with claim 1 including using high sulfur coal and limestone as the fuel, and removing sulfur dioxide from the combustion effluent by a dry scrubber system having a cyclone separator, granular bed filter and cooler in that order.

6. A method in accordance with claim 1 including using separate independently removable conduits for each downshot grid in each chamber so that any downshot grid may be removed without interrupting fluidization in an adjacent chamber.

7. A method in accordance with claim 1 including providing said upright walls with an opening to facilitate cross flow of fluidized fuel between adjacent fluidized chambers while providing a seal in the event that the bed in one of the adjacent chambers is slumped to prevent such cross flow without using any adjustable parts.

8. Apparatus for generating steam comprising:

a. a combustor housing having a plurality of discrete chambers side by side and separated by upright walls of good heat conductive material, b. a discrete vertically disposed tube bundle in each chamber, conduit means for supplying water to each tube bundle, conduit means for collecting steam from the upper end of each tube bundle, c. a discrete independently operable downshot air fluidizing grid in each chamber for fluidizing a fuel bed thereabove, means for feeding fuel to each chamber, d. at least one draw-off hopper below the elevation of said grids with the hopper being tapered to the angle of friction of ash solids so that the solids descend as a mass, e. means for separately igniting the fluidized bed in each chamber, and f. means for modulating the amount of steam collected and the steam demand changes to thereby change the rate of production of steam in said steam bundles in a manner so that one or more nonadjacent beds may be slumped and/or the height of fuel in one or more of said beds may be changed.

9. Apparatus in accordance with claim 8 wherein said combustor housing is circular in cross section with a central core, and said chambers being circumferentially disposed about said core.

10. Apparatus in accordance with claim 8 wherein each downshot grid is comprised of a plurality of grid conduits extending through a wall of said housing and being removable through said housing wall, each grid conduit being removably coupled to a common manifold.

11. Apparatus in accordance with claim 8 including means for cooling ash in a collection chamber disposed below the elevation of said grids and above the elevation of said hopper.

* * * * *